US006938688B2

(12) United States Patent
Lengauer, Jr. et al.

(10) Patent No.: US 6,938,688 B2
(45) Date of Patent: Sep. 6, 2005

(54) COMPACT HIGH EFFICIENCY CLAM SHELL HEAT EXCHANGER

(75) Inventors: Philip E. Lengauer, Jr., Clarks Mills, PA (US); Werner O. Specht, Hermitage, PA (US); Donald G. Warren, Cordova, TN (US); Dominick J. DiMaggio, Hermitage, PA (US)

(73) Assignee: Thomas & Betts International, Inc., Sparks, NV (US)

( * ) Notice: Subject to any disclaimer, the term of this patent is extended or adjusted under 35 U.S.C. 154(b) by 247 days.

(21) Appl. No.: 10/299,314

(22) Filed: Nov. 19, 2002

(65) Prior Publication Data

US 2003/0102115 A1 Jun. 5, 2003

Related U.S. Application Data

(60) Provisional application No. 60/336,570, filed on Dec. 5, 2001.

(51) Int. Cl.[7] ..... F24H 3/02

(52) U.S. Cl. ..... 165/170; 165/146; 126/110

(58) Field of Search ..... 165/109.1, 146, 165/170; 126/110, 116

(56) References Cited

U.S. PATENT DOCUMENTS 3,399,661 A 9/1968 Kreis
4,006,728 A 2/1977 Nishi et al.

(Continued)

FOREIGN PATENT DOCUMENTS

DE 29713418 U1 3/1998
EP 0 908 686 A2 4/1999
WO WO 00/73711 A1 12/2000

*Primary Examiner*—Allen J. Flanigan
(74) *Attorney, Agent, or Firm*—Hoffmann & Baron, LLP

(57) ABSTRACT

A clamshell heat exchanger comprises upper and lower clamshell plates assembled together and sealed at the peripheral edges thereof, the assembled plates defining at least three internal passageways communicating in a serpentine configuration. The passageways include an inlet passageway having an inlet port for receipt therethrough of combustion gases, an intermediate passageway and an exhaust passageway having an exit port for the discharge of combustion gases, all such passageways lying generally parallel to each other. In one arrangement of the heat exchanger, the upper and lower clamshell plates define an air gap between the inlet passageway and the intermediate passageway, with the intermediate passageway and the exhaust passageway being joined by a secured flattened portion of the upper and lower clamshell plates. In another arrangement, instead of an air gap, the inlet passageway and the intermediate passageway are also joined by secured flattened portions of the upper and lower clamshell plates. Turbulent flow structure is provided by dimpled surfaces projecting inwardly into the intermediate and exhaust passageways and a longitudinally extending rib projecting into the intermediate passageway. A drain shunt, defined by a generally tubular channel, communicates between the intermediate passageway and the exhaust passageway to allow drainage of condensation from the heat exchanger when the heat exchanger is disposed in any orientation.

26 Claims, 6 Drawing Sheets

U.S. PATENT DOCUMENTS 4,467,780 A * 8/1984 Ripka ..... 126/110 R
4,621,686 A * 11/1986 Ahn ..... 165/113
4,730,600 A 3/1988 Harrigill
4,738,307 A 4/1988 Bentley
4,947,548 A 8/1990 Bentley
4,982,785 A * 1/1991 Tomlinson ..... 165/170
4,989,670 A 2/1991 Foley
5,010,643 A 4/1991 Zohler
5,042,453 A 8/1991 Shellenberger
5,060,722 A 10/1991 Zdenek et al.
5,074,280 A 12/1991 Evens
5,113,844 A 5/1992 Cook
5,203,404 A 4/1993 Chiang et al.
D335,337 S 5/1993 Shellenberger
5,267,610 A 12/1993 Culbert
5,271,376 A 12/1993 Lu et al.
5,301,654 A 4/1994 Weber, III et al.
5,332,034 A 7/1994 Chiang et al.
5,333,598 A 8/1994 Mielke et al.
5,333,682 A 8/1994 Liu et al.
5,346,001 A * 9/1994 Rieke et al. ..... 165/170
5,359,989 A * 11/1994 Chase et al. ..... 126/110 R
D360,258 S 7/1995 Shellenberger
5,437,263 A * 8/1995 Ellingham et al. ..... 126/110 R
5,448,986 A 9/1995 Christopher et al.
5,623,988 A * 4/1997 Holowczak et al. ..... 165/134.1
5,671,808 A 9/1997 Kleyn
6,006,741 A 12/1999 Daddis, Jr.
6,109,254 A 8/2000 Reinke et al.
6,484,798 B1 * 11/2002 Manohar et al. ..... 165/170
2002/0040777 A1 * 4/2002 Tomlinson et al. ..... 165/163
2003/0127218 A1 * 7/2003 Sears et al. ..... 165/170

* cited by examiner 20
20a
20b
20c
20d
20e
20f
20g
30
32
36
38
40
42
44
46
48
54
58
60
62
64
66
68
70
72
74
76
78
80
82
84
86
88
90
92
94
96
98
100
102
104
106
108
110
112
114
116
118
120
122
124
126
128
130
132
134
136

COMPACT HIGH EFFICIENCY CLAM SHELL HEAT EXCHANGER

CROSS-REFERENCE TO RELATED APPLICATION

This application claims priority from U.S. Provisional Patent Application No. 60/336,570 filed Dec. 5, 2001.

FIELD OF THE INVENTION

The present invention relates generally to heat exchangers for use in a gas fired hot air furnace. More particularly, the present invention relates to compact high efficiency clam shell heat exchangers.

BACKGROUND OF THE INVENTION

Heat exchangers are commonly used in gas fired hot air furnaces in both residential and commercial settings. Heat exchangers are generally divided into two types. The first type includes tubular heat exchangers wherein a tube is formed into a serpentine configuration and hot combustion gases are allowed to propagate within the tube. The second type of heat exchangers more commonly used in compact designs are clam shell heat exchangers. Clam shell heat exchangers employ a pair of metal sheets or plates which are disposed in face to face relationship and are configured to provide a passageway for the flow of hot combustion gases. These type of heat exchangers are referred to as clam shell heat exchangers since they are formed of two separate mirror-imaged sheets which are joined together.

In typical use in a furnace, a series of heat exchangers are provided in which hot combustion gases pass through the heat exchangers transferring heat to the surfaces of the heat exchanger. Forced air passed externally over the heat exchanger is warmed and circulated into the room which is to be heated. To efficiently transfer the heat from the hot combustion gases to the heat exchangers, the heat exchangers are designed to cause a turbulent flow within the internal passageways. Turbulent flow causes the heated gases to interact with the walls of the heat exchangers so as to provide effective and efficient heat transfer.

Various techniques have been employed to provide turbulent flow in the heat exchanger passageways. U.S. Pat. No. 4,467,780 describes a clam shell heat exchanger having a series of dimples formed within the passageways of the heat exchanger. The dimples create obstacles within the gas flow stream thereby increasing the velocity of the combustion products and resulting in efficient heat transfer. U.S. Pat. No. 4,982,785 also shows a clam shell serpentine heat exchanger wherein a series of ribs and dimples are employed in the passageway to increase turbulence and facilitate heat transfer. U.S. Pat. No. 5,359,989 discloses a clam shell heat exchanger wherein each of the passageways in the heat exchanger is further divided into individual connected passageways. These passageways are of sequentially decreasing diameter so as to increase the velocity of the combustion gases passing therethrough. This is also designed to render the heat transfer more efficient. While each of the above-referenced patents attempt to maximize heat transfer between the combustion gases and the surface of the heat exchanger by increasing the velocity and the turbulent flow of the combustion gases within the heat exchanger passageway, further improved heat transfer efficiency in a compact clam shell heat exchanger is desirable.

SUMMARY OF THE INVENTION

In accordance with the present invention, the foregoing disadvantages of the prior art are addressed. In one aspect of the present invention, a furnace heat exchanger comprises conductive structure defining at least three passageways for the flow of combustion gases therethrough, including an inlet passageway, an intermediate passageway communicating with the inlet passageway and an exhaust passageway communicating with the intermediate passageway. The passageways lie generally parallel to each other with the intermediate passageway being situated between the inlet and exhaust passageways. The inlet passageway and the intermediate passageway are separated by an air gap. The intermediate passageway and the exhaust passageway are joined therebetween by common portions of the conductive structure.

In another aspect of the present invention, a furnace heat exchanger comprises conductive structure defining at least three passageways for the flow of combustion gases therethrough, the passageways including an inlet passageway, an intermediate passageway communicating with the inlet passageway and an exhaust passageway communicating with the intermediate passageway. The inlet passageway has an inlet port for receipt therethrough of combustion gases. The exhaust passageway has an exit port for discharge therethrough of combustion gases. The passageways lie generally parallel to each other with the intermediate passageway being situated between the inlet and exhaust passageways. A drain channel defined by a portion of the conductive structure communicates between the exhaust passageway and one of the other passageways.

In a further aspect of the invention, a furnace heat exchanger comprises first and second clamshell plates assembled together and defining at least three internal passageways communicating in a serpentine configuration. The passageways include an inlet passageway, an intermediate passageway and an exhaust passageway lying generally parallel to each other. The first and second clamshell plates define between at least two of the passageways a flattened divider section secured by at least one fastener which has a wall portion projecting into each of the two divided passageways for providing a region within the divided passageways for turbulent gas flow.

In yet another aspect of the present invention, a furnace heat exchanger comprises upper and lower clamshell plates assembled together and defining at least three internal passageways communicating in a serpentine configuration. The passageways include an inlet passageway, an intermediate passageway and an exhaust passageway lying generally parallel to each other. The heat exchanger further includes turbulent flow structure consisting essentially of a plurality of dimpled surfaces projecting inwardly of the intermediate passageway and the exhaust passageway, and a longitudinally extending rib projecting into the intermediate passageway.

DESCRIPTION OF THE PREFERRED EMBODIMENTS

Figure 1:
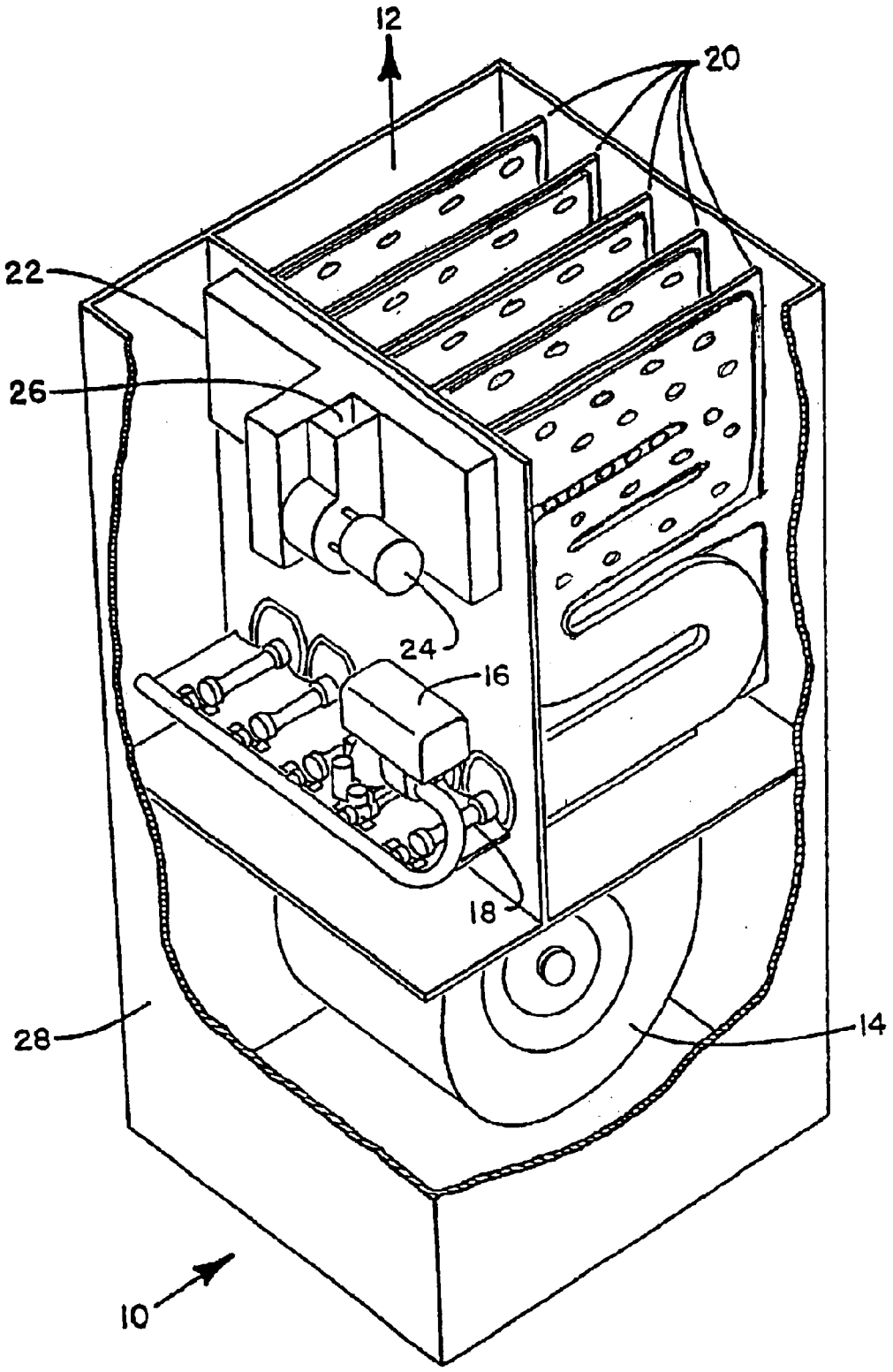
FIG. 1 is a perspective view of a hot air furnace partially broken away to reveal a plurality of clam shell heat exchangers in accordance with the present invention.

Referring now to the drawings, there is shown in FIG. 1 a compact hot air furnace 10 which includes heat exchangers in accordance with the present invention as described herein. The furnace 10 has a sheet metal outer covering 28 which encases a series of five heat exchangers 20, blower 14, burners 18, one for each heat exchanger 20, and gas and pressure regulator 16. Burners 18 are arranged so that they receive fuel gas from the pressure regulator 16. This gas is injected by burner 18 into the open end of a heat exchanger 20. As a part of the injection process, air is drawn into the heat exchanger so that the gas and the air may be combusted within the heat exchanger 20. A header 22 is connected to the exhaust portion of each of the heat exchangers and is also connected to an induction draft unit 24 which creates a suction pressure through the heat exchangers 20 to exhaust the discharged gases resulting from combustion through opening 26 to the discharge flue. Blower 14 receives cold room air from the area which is to be heated, forces that air over the heat exchanger surfaces in the direction indicated by arrow 12. The heated air is then collected and returned to the rooms to be heated. While burners 18 are conventionally known burners, it should be appreciated that other suitable burners may be used in conjunction with the heat exchangers in a hot air furnace. For example, a one-piece burner for multiple-sectioned heat exchangers, as more fully described in commonly-owned, copending patent application U.S. Ser. No. 10/299,479, entitled "One Shot Heat Exchanger Burner" and filed on even date herewith, may be used in place of burners 18, the disclosure of which is incorporated herein by reference for all purposes.

Figure 2:
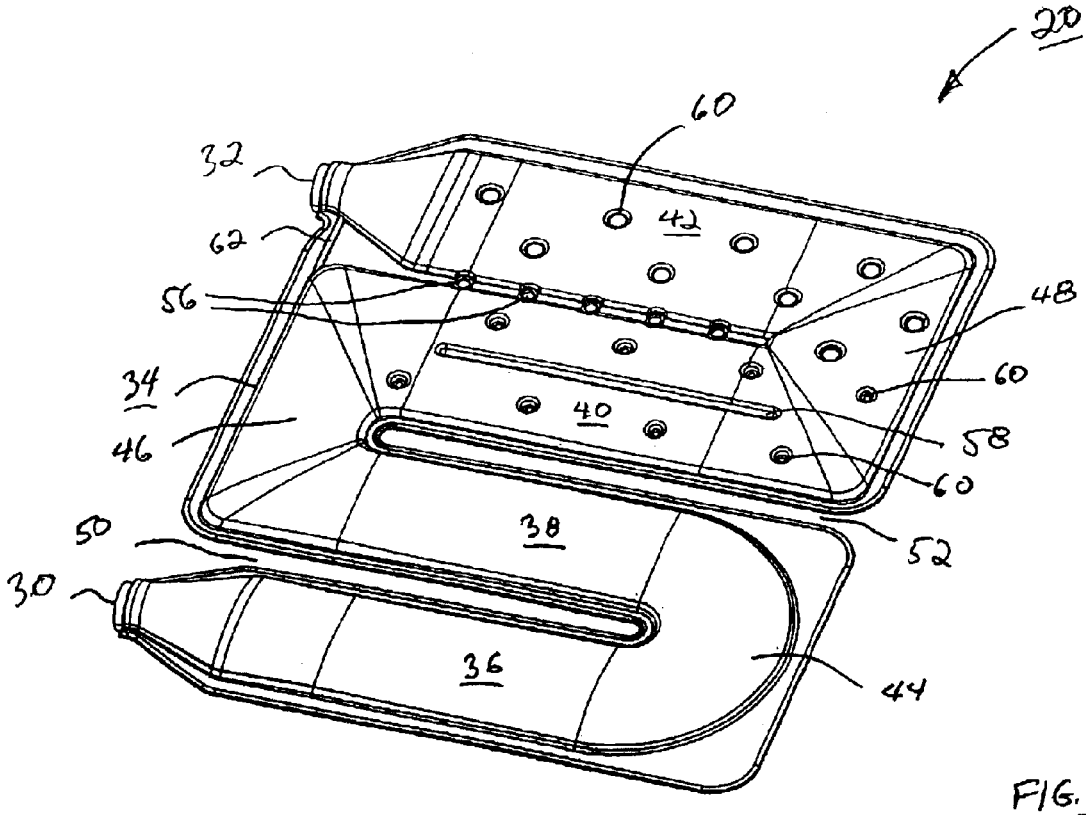
FIG. 2 is a top perspective view of one embodiment of a four-pass serpentine, clam shell heat exchanger.
Figure 3:
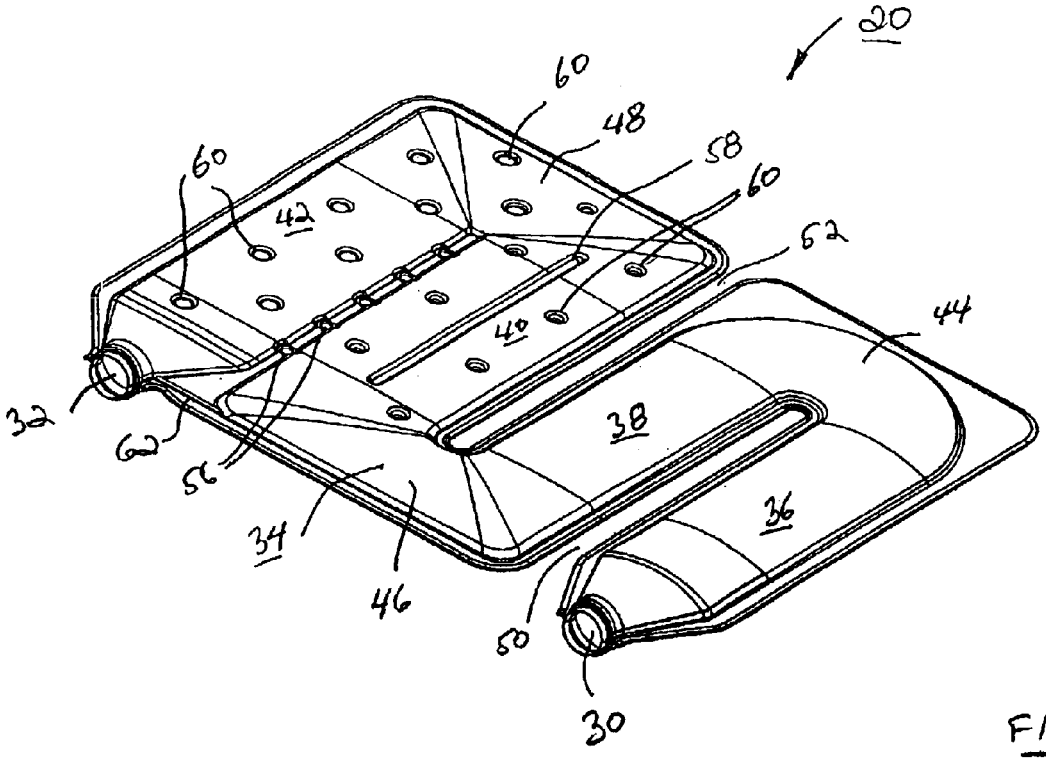
FIG. 3 is a front perspective view of the heat exchanger of FIG. 2.
Figures 4, 5, 6, 7, 8, 9, 10, 11:
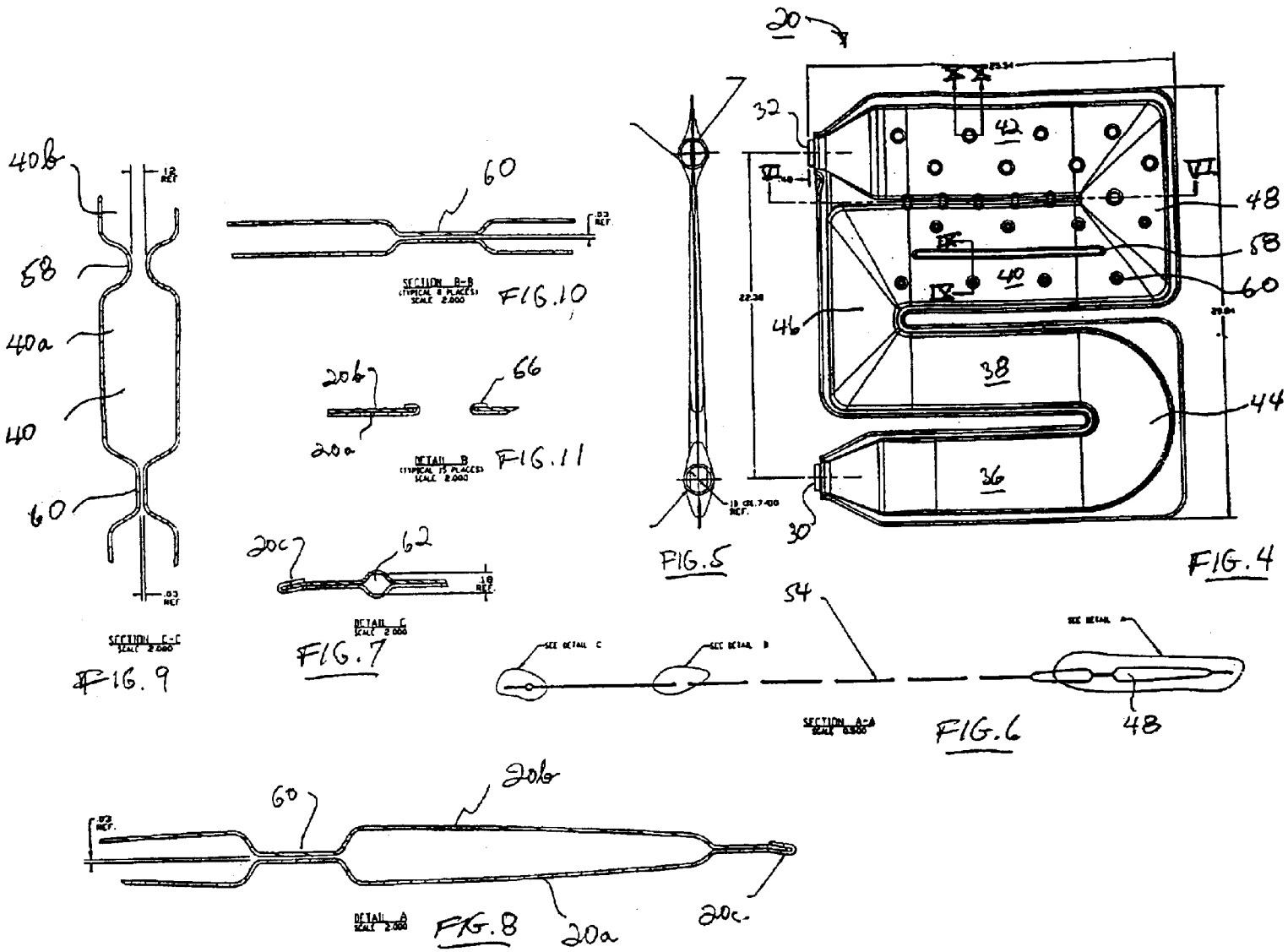
FIG. 4 is a plan view of the heat exchanger of FIG. 2.
FIG. 5 is a front elevation view of the heat exchanger of FIG. 4.
FIG. 6 is a cross-sectional view of FIG. 4 as seen along viewing line VI—VI.
FIG. 7 is an enlarged view of a portion of the cross-section of FIG. 7 as illustrated in detail C thereof.
FIG. 8 is an enlarged view of the cross-section of FIG. 6 as seen in detail A thereof.
FIG. 9 is a cross-sectional view of FIG. 4 as seen along viewing line IX—IX.
FIG. 10 is a cross-sectional view of FIG. 4 as seen along viewing line X—X.
FIG. 11 is an enlarged view of the cross-section of FIG. 6 as shown in detail B thereof.

Referring now to FIGS. 2, 3 and 4, details of the heat exchangers 20 are described. Heat exchanger 20 as shown defines a serpentine configuration, including an inlet port 30, an exit port 32, and a four-pass serpentine passageway 34 communicating and interconnecting ports 30 and 32. Serpentine passageway 34 comprises four passageways, namely, inlet passageway 36, two intermediate passageways 38 and 40 and exhaust passageway 42. Inlet passageway 36 communicates with inlet port 30 and is connected to intermediate passageway 38 by a bend channel 44. Intermediate passageway 38 is interconnected with intermediate passageway 40 by a connecting channel 46. Intermediate passageway 40 is interconnected with exhaust passageway 42 by a connecting channel 48. Exhaust passageway 42 directly communicates with exhaust port 32.

As seen also with reference to FIGS. 6–8, each one of the heat exchangers 20 includes a first lower plate member 20*a* and an upper plate member 20*b* secured together in face-to-face relation. The plate members 20*a* and 20*b* have surfaces stamped or otherwise formed into substantial mirror images of each other. The upper and lower plates 20*a* and 20*b* are folded and sealably crimped as shown at 20*c* in FIG. 8 around the entire periphery of the heat exchanger 20, except at the inlet port 30 and exhaust port 32. The upper and lower plates 20*a* and 20*b* are formed in accordance with the particular embodiment being described herein to provide an air space 50 between inlet passageway 36 and intermediate passageway 38, as well as an air space 52 between intermediate passageway 38 and intermediate passageway 40, as will be described. While intermediate passageway 40 and exhaust passageway 42 share common, continuous portions of upper and lower plates 20*a* and 20*b*, they are separated by a flattened divider section 54, whereat the upper and lower sections 20*a* and 20*b* are securely fastened by a plurality of clinch hole fasteners 56 (see FIG. 11). Clinch hole fasteners are formed by punching through the upper plate surface 20*b* and wrapping an extruded portion of lower surface 20*a* back to overlap upper surface 20*a*. Clinch hole fasteners 56 as used herein are more fully described in U.S. Pat. No. 5,060,722, the disclosure of which is herein incorporated by reference.

The lower plate 20*a* and the upper plate 20*b* of the heat exchanger 20 may be comprised of corrosion-resistant metallic materials, such as aluminized steel, 409 stainless steel, or a coated metal material. In the preferred embodiment, aluminized steel is used.

In intermediate passageway 40, heat exchanger 20 is provided with a longitudinally extending rib 58 and a plurality of inwardly projecting dimples 60, the details of which are illustrated in FIG. 9. Longitudinally extending rib 58 extends substantially along the length of intermediate passageway 40, substantially centrally therewithin, effectively dividing passageway 40 into two smaller rectangular passageways 40*a* and 40*b*. The flow of the combustion products through passageway 40 is disrupted by the rib 58 causing the flow to be turbulent rather than laminar and effectively causing the hot central core of the combustion gases to flow outwardly toward the edges of the passageway 40, thereby increasing the uniformity of the heat distribution throughout passageway 40. Dimples 60 extending into passageway 40 further compound the turbulence caused by rib 58. As such, the dimples 60 create further obstacles within the gas flow stream resulting in additional mixing which increases the velocity of the combustion products through passageway 40. Additional dimples 60 are provided in connecting channel 48 as well as in exhaust passageway 42 to stimulate turbulent gas flow therewithin.

As seen now with respect also to FIGS. 5 and 9, the interior surfaces of the passageways which comprise serpentine passageway 34 have cross-sectional areas as follows. Inlet passageway 36 has a generally elliptical cross-sectional area. Intermediate passageways 38 and 40 (without rib 58) both have cross-sectional areas that are substantially identical, but less than the cross-sectional area of inlet passageway 36. Exhaust passageway 42 has a generally rectangular flattened cross-sectional area, less than the cross-sectional areas of intermediate passageways 38 and 40. The changing cross-sectional areas from the inlet passageway 36 to the exhaust passageway 42 assist in increasing the efficiency of heat transfer from the combustion gases to the heat exchanger walls. By way of specific example, the cross-sectional area of inlet passageway 36 is 5.1 $in^2$. The cross-sectional areas of intermediate passageways 38 and 40 (without rib 58) are each 3.8 $in^2$. The cross-sectional area of passageway 40 through rib 58 is slightly reduced to 3.6 $in^2$. The cross-sectional area of exhaust passageway 32 is 1.6 $in^2$. It should be appreciated that these dimensions illustrate one particular arrangement and that the invention is not limited thereto.

With the serpentine heat exchanger inlet port 30 connected to the furnace burner, combustion typically occurs in the inlet passageway 36. As such, inlet passageway into which the burner fires is the hottest and each subsequent passageway operates at a sequentially lower temperature as cooling air passing over the outer surfaces of the heat exchanger 20 removes the heat from the products of combustion. As a result of temperature differences in the heat exchanger metal, different degrees of thermal expansion will occur, thereby inducing undesirable mechanical stresses. Accordingly, in the embodiment being described, inlet passageway 36 is separated from intermediate passageway 38 by an air space 50 while the two intermediate passageways 38 and 40 are separated by air space 52. Air spaces 50 and 52 provide an additional degree of freedom for the thermal expansion and thereby act to minimize the mechanical stress due to temperature differentials in the heat exchanger.

As shown in FIGS. 2–3, with further details shown in FIG. 7, heat exchanger 20 comprises a drain shunt 62, defined by a generally tubular channel communicating with intermediate passageway 40 and exhaust passageway 42. Drain shunt 62 allows condensate (water vapor that may condense to liquid form on the internal surfaces of the heat exchanger 20) to drain from the heat exchanger in any orientation from vertical (inlet port 30 and exit port 32 being parallel to the acting force of gravity) to within a few degrees of horizontal (inlet port 30 and exhaust port 32 being perpendicular to the acting force of gravity), thereby improving resistance to corrosion and subsequently extending the life expectancy of the heat exchanger. Condensate may accumulate in heat exchangers 20 when the temperature of an internal wall drops below the dew point temperature of the air adjacent to the wall surface.

It should now be appreciated that the features of the heat exchanger described herein enhance desired heat exchanger performance in a hot-air furnace. For example, the unique pattern of dimples 60 and rib 58 are used as internal flow obstructions to promote turbulence in localized high velocity swirl to force reformation of combustion gas boundary layers in the gas flow. In addition, the clinch hole fasteners 56 in the divider section 54 between intermediate passageway 40 and exhaust passageway 42 increase the rigidity of the divider section 54 and minimize leakage of combustion gases between the passageways 40 and 42. Further, the walls of the clinch hole fasteners in the divider section 54 assist in creating further regions of flow disturbance that result in enhanced turbulence in passageways 40 and 42. Moreover, by minimizing the width of the divider section 54 between intermediate passageway 40 and exhaust passageway 42, and employing the clinch hole fasteners for attachment strength, the amount of material that is not in direct contact with the combustion gases is minimized, thereby improving the performance of these sections of the heat exchanger 20.

Figure 12:
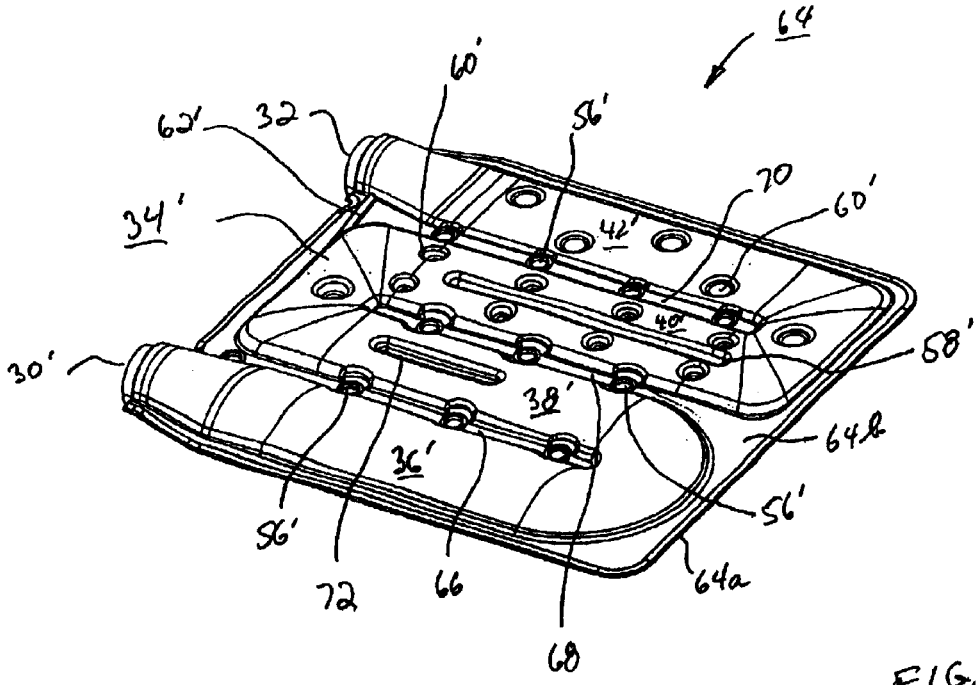
FIG. 12 is a top perspective view of another embodiment of a compact clam shell heat exchanger in accordance with the present invention.
Figure 13:
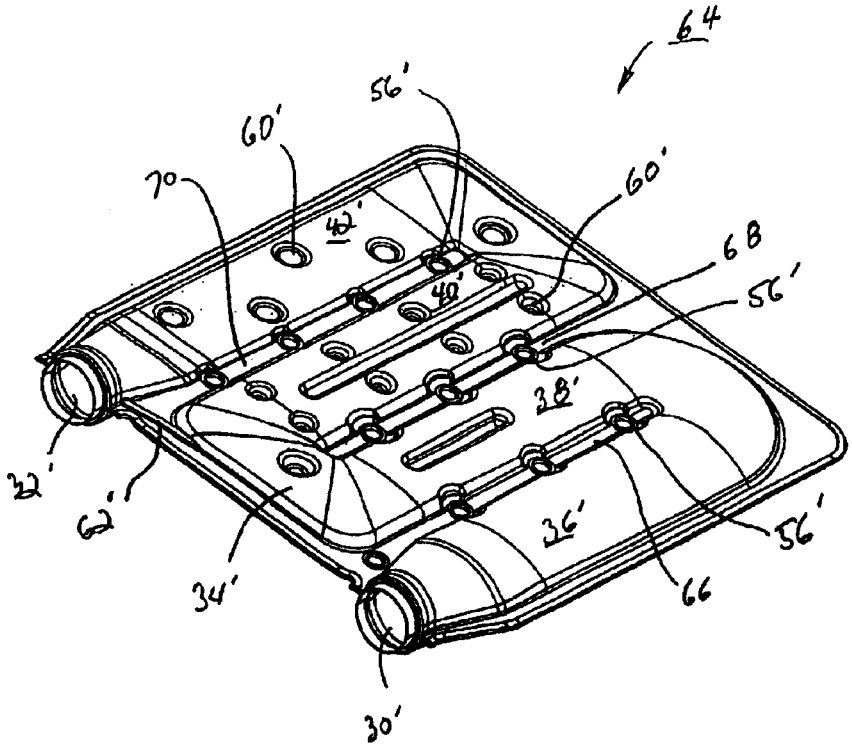
FIG. 13 is a front perspective view of the heat exchanger of FIG. 12.

Turning now to FIGS. 12 and 13, another embodiment of the clam shell heat exchanger in accordance with the present invention is described. As shown in FIGS. 12 and 13, heat exchanger 64 comprises a four-pass serpentine passageway 34' similar to heat exchanger 20. Heat exchanger 64 is constructed similar to the construction of heat exchanger 20 in that it includes an upper plate member and a lower plate member formed into substantially mirror images of each other, which are secured together in face-to-face relation. Unlike the heat exchanger 20, heat exchanger 64 does not have spaces, such as air gaps 50 and 52, between inlet passageway 36' and intermediate passageway 38' or between the two intermediate passageways 38' and 40'. Heat exchanger 64 comprises a single contiguous piece of sheet metal defining a lower plate member **64*a* and a single contiguous piece of sheet metal defining upper plate member 64*b* that are suitably mechanically crimped around the peripheral edges (except for the inlet port 30' and exhaust port 32') to form a gastight seal therearound. Flattened divider sections 66, 68 and 70 are respectively formed between inlet passageway 36' and intermediate passageway 38', between intermediate passageways 38' and 40', and between intermediate passageway 40' and exhaust passageway 42'. Similar to the joined divider section 54 in heat exchanger 20, each of the divider sections 66, 68 and 70 in heat exchanger 64 are mechanically joined by a series of clinch hole fasteners 56' along each of the divider sections 66, 68 and 70**.

Similar to the construction of heat exchanger 20, heat exchanger 64 also includes for enhanced turbulence and heat transfer efficiency, a plurality of dimples 60' extending within passageways 40' and 42', as well as a longitudinally extending centrally located rib 58' projecting within passageway 40'. In addition, a longitudinally extending rib 72 is formed to project internally of intermediate passageway 38', rib 72 extending longitudinally along a portion of the length of passageway 38'. Similar to rib 58', rib 72 serves as a gas flow splitter diverting the flow of gases outwardly toward the peripheral edges of the passageway 38' to thereby more uniformly distribute the heat and increase heat transfer efficiency.

While preferably smaller than the heat exchanger 20, the configuration of the serpentine passageways in heat exchanger 64 is similar to the passageways in heat exchanger 20. In particular, inlet passageway 36' is of generally elliptical configuration while the internal configurations of passageways 38', 40' and 42' are generally rectangular. The cross-sectional area of inlet passageway 36' is the largest of the passageways, while the cross-sectional area of the exhaust passageway 42' is the smallest. The cross-sectional areas of intermediate passageways 38' and 40' are substantially identical, each being smaller than the cross-sectional area of inlet passageway 36' but larger than the cross-sectional area of exhaust passageway 42'. As such, the changes in the cross-sectional area in the passageways from inlet port 30' to exhaust port 32' result in increased heat transfer efficiency. As specific examples, inlet passageway 36' has a cross-sectional area of 3.0 $in^2$ and intermediate passageways 38' and 40' each have a cross-sectional area of 1.8 $in^2$ (without the respective ribs 72 and 58') and a cross-sectional area of 1.5 $in^2$ (through respective ribs 72 and 58'). Exhaust passageway 42' has a cross-sectional area of 0.7 $in^2$. These dimensions are for illustrative purposes, it being understood that the present invention is not limited thereto.

A drain shunt 52' is also provided between passageways 40' and 42' to allow any condensate to drain from the heat exchanger 64 as described hereinabove with respect to heat exchanger 20.

Having described the preferred embodiments herein, it should now be appreciated that variations may be made thereto without departing from the contemplated scope of the invention. Accordingly, the preferred embodiments described herein are deemed illustrative rather than limiting, the true scope of the invention being set forth in the claims appended hereto.

What is claimed is:

1. A furnace heat exchanger comprising:

conductive structure defining at least three passageways for the flow of combustion gases therethrough, said passageways including an inlet passageway, an intermediate passageway communicating with said inlet passageway and an exhaust passageway communicating with said intermediate passageway, said passageways lying generally parallel to each other with said intermediate passageway being situated between said inlet and said exhaust passageways, said inlet passageway and said intermediate passageway being separated by an air gap, said intermediate passageway and said exhaust passageway being joined therebetween by common portions of said conductive structure;

wherein each of said passageways has a cross-section of different area, the cross-sectional area of said inlet passageway being the largest.

2. A heat exchanger according to claim 1, wherein said intermediate passageway defines a first intermediate passageway, and wherein said conductive structure further defines a second intermediate passageway communicating with said first intermediate passageway and said exhaust passageway and lying generally parallel therebetween.

3. A heat exchanger according to claim 1, wherein said conductive structure defines a further air gap between said first intermediate passageway and said second intermediate passageway.

4. A heat exchanger according to claim 3, wherein said second intermediate passageway has a cross-sectional area substantially the same as the cross-sectional area of said first intermediate area.

5. A heat exchanger according to claim 4, wherein the cross-section of said inlet passageway is generally elliptical, the cross-sections of said first intermediate passageway and said second intermediate passageway are generally rectangular, and the cross-section of said exhaust passageway is generally rectangular but smaller than the cross-sections of the first and second intermediate rectangular passageways.

6. A heat exchanger according to claim 5, wherein said conductive structure comprises a lower plate member and an upper plate member assembled together and sealed at the peripheral edges, the lower plate and upper plate defining an inlet port at the entrance of the inlet passageway for receipt of combustion gases therethrough and an exit port at the outlet of the exhaust passageway for discharge of combustion gases therethrough.

7. A heat exchanger according to claim 6, wherein said upper plate and said lower plate define a flattened divider section between said second intermediate passageway and said exhaust passageway.

8. A heat exchanger according to claim 7, wherein said flattened divider section is secured by at least one fastener.

9. A heat exchanger according to claim 8, wherein said second intermediate passageway comprises a plurality of dimpled surfaces projecting inwardly into said second intermediate passageway.

10. A heat exchanger according to claim 9, wherein said exhaust passageway comprises a plurality of dimpled surfaces projecting inwardly into said exhaust passageway.

11. A heat exchanger according to claim 10, wherein said second intermediate passageway further comprises a longitudinally extending rib extending into said second intermediate passageway.

12. A heat exchanger according to claim 11, wherein said fastener includes a wall portion projecting into each of said second intermediate passageway and said exhaust passageway for providing a region for turbulent gas flow.

13. A heat exchanger according to claim 1, wherein said upper plate and lower plate define a drain channel communicating between said intermediate channel and said exhaust channel.

14. A furnace heat exchanger, comprising:

conductive structure defining at least three passageways for the flow of combustion gases therethrough, said passageways including an inlet passageway, an intermediate passageway communicating with said inlet passageway and an exhaust passageway communicating with said intermediate passageway, said inlet passageway having an inlet port for receipt therethrough of combustion gases, said exhaust passageway having an exit port for discharge therethrough of combustion gases, said passageways lying generally parallel to each other with said intermediate passageway being situated between said inlet and said exhaust passageways, a drain channel defined by a portion of said conductive structure communicating between said exhaust passageway and one of said other passageways;

wherein said conductive structure comprises a lower plate member and an upper plate member assembled together and sealed at the peripheral edges, the lower plate and upper plate defining an inlet port at the entrance of the inlet passageway for receipt of combustion gases therethrough and an exit port at the outlet of the exhaust passageway for discharge of combustion gases therethrough.

15. A heat exchanger according to claim 14, wherein said upper and lower plate members define said intermediate passageway as a first intermediate passageway, and wherein said upper and lower plate members further define a second intermediate passageway communicating with said first intermediate passageway and said exhaust passageway and lying generally parallel therebetween.

16. A heat exchanger according to claim 15, wherein said upper and lower plate members define an air gap between said inlet passageway and said first intermediate passageway.

17. A heat exchanger according to claim 16, wherein said upper and lower plate members define an air gap between said first intermediate member and said second intermediate member.

18. A heat exchanger according to claim 15, wherein said upper and lower plate members define a flattened secured divider section between at least two of said passageways.

19. A heat exchanger according to claim 18, wherein said a flattened secured divider section is defined between all of said respective passageways.

20. A furnace heat exchanger, comprising:

first and second clamshell plates assembled together and defining at least three internal passageways communicating in a serpentine configuration, said passageways including an inlet passageway, an intermediate passageway and an exhaust passageway lying generally parallel to each other, said first and second clamshell plates defining between at least two of said passageways a flattened divider section secured by at least one fastener having a wall portion projecting into each of said two divided pas sageways for providing a region within said divided passageways for turbulent gas flow.

21. A heat exchanger according to claim 20, wherein said flattened divider sections is secured by a plurality of said fasteners.

22. A heat exchanger according to claim 21, wherein each of said fasteners includes a clinch hole fastener having a hole formed through said first and second clamshell plates, an extruded portion of one of said clamshell plates overlapping a portion of the other of said clamshell plates adjacent said hole.

23. A heat exchanger according to claim 22, wherein a portion of said clinch hole fasteners defines the wall portion projecting into said passageways.

24. A furnace heat exchanger, comprising:

upper and lower clamshell plates assembled together and defining at least three passageways communicating in a serpentine configuration;

said passageways including an inlet passageway, an intermediate passageway and an exhaust passageway lying generally parallel to each other, and turbulent flow structure consisting essentially of:

a plurality of dimpled surfaces projecting inwardly of said intermediate passageway and said exhaust passageway, and a longitudinally extending rib projecting into said intermediate passageway.

25. A heat exchanger according to claim 24, wherein said upper and lower clamshell plates include a fourth passageway defined by a further intermediate passageway, said further intermediate passageway lying between and in communication with said inlet passageway and said intermediate passageway.

26. A heat exchanger according to claim 24, wherein said turbulent flow structure further consists essentially of a further longitudinally extending rib projecting into said further intermediate passageway.

* * * * *